US011161707B2

(12) United States Patent
Nishida et al.

(10) Patent No.: US 11,161,707 B2
(45) Date of Patent: Nov. 2, 2021

(54) PAPER SHEET FEEDING APPARATUS AND FOREIGN OBJECT DETECTION METHOD

(71) Applicant: FUJITSU FRONTECH LIMITED, Inagi (JP)

(72) Inventors: Mitsutaka Nishida, Inagi (JP); Hayato Minamishin, Inagi (JP); Naoto Ikeda, Inagi (JP); Tatsuya Shimamura, Inagi (JP)

(73) Assignee: FUJITSU FRONTECH LIMITED, Inagi (JP)

( * ) Notice: Subject to any disclaimer, the term of this patent is extended or adjusted under 35 U.S.C. 154(b) by 189 days.

(21) Appl. No.: 16/359,517

(22) Filed: Mar. 20, 2019

(65) Prior Publication Data

US 2019/0217639 A1 Jul. 18, 2019

Related U.S. Application Data

(63) Continuation of application No. PCT/JP2016/078725, filed on Sep. 28, 2016.

(51) Int. Cl.
*B65H 7/06* (2006.01)
*B41J 13/10* (2006.01)
(Continued)

(52) U.S. Cl.
CPC ..... *B65H 7/06* (2013.01); *B41J 13/103* (2013.01); *B65H 1/025* (2013.01); *B65H 3/0669* (2013.01);
(Continued)

(58) Field of Classification Search
CPC ..... B65H 2511/521; B65H 2553/612; B65H 7/06; B65H 7/08; B65H 2511/152;
(Continued)

(56) References Cited

U.S. PATENT DOCUMENTS 6,354,589 B1 * 3/2002 Taruki ..... B65H 3/00 271/225
8,235,379 B2 * 8/2012 Lee ..... B65H 7/14 271/117
(Continued)

FOREIGN PATENT DOCUMENTS

JP 4-50264 4/1992
JP 5-132169 5/1993
(Continued)

OTHER PUBLICATIONS

Office Action, dated Mar. 5, 2020, in corresponding Indian Application No. 201937009025 (6 pp.).
(Continued)

*Primary Examiner* — Jeremy R Severson
(74) *Attorney, Agent, or Firm* — Stass & Halsey, LLP

(57) ABSTRACT

A paper sheet feeding apparatus includes an inserting unit in which a paper sheet is inserted, a pick-up roller for picking up a paper sheet inserted in the inserting unit, a rotating shaft for rotating the pick-up roller, a detecting member that is supported by the rotating shaft so as to be able to rotate around the rotating shaft and is rotated by a bundling member that bundles paper sheets together, and a first detecting unit that detects rotation of the detecting member.

9 Claims, 6 Drawing Sheets

(51) Int. Cl.

| | |
|---|---|
| ***B65H 3/06*** | (2006.01) |
| ***B65H 29/20*** | (2006.01) |
| ***B65H 31/06*** | (2006.01) |
| ***B65H 83/02*** | (2006.01) |
| ***B65H 1/02*** | (2006.01) |

(52) U.S. Cl.
CPC ..... *B65H 29/20* (2013.01); *B65H 31/06* (2013.01); *B65H 83/02* (2013.01); *B65H 2220/03* (2013.01); *B65H 2403/942* (2013.01); *B65H 2511/521* (2013.01); *B65H 2553/612* (2013.01); *B65H 2701/1912* (2013.01)

(58) Field of Classification Search
CPC .. B65H 2511/162; B65H 3/06; B65H 3/0653; B65H 7/20; B65H 2701/1912; B65H 2701/182; B65H 2701/1829; B65H 3/0669; B65H 29/20; B41J 13/103

See application file for complete search history.

(56) References Cited

U.S. PATENT DOCUMENTS

| | | | | |
|---|---|---|---|---|
| 9,950,888 | B2 * | 4/2018 | Yonemura ..... | B65H 5/06 |
| 10,138,084 | B2 * | 11/2018 | Ohno ..... | B65H 7/06 |

FOREIGN PATENT DOCUMENTS

| | | | |
|---|---|---|---|
| JP | 2006-206231 | | 8/2006 |
| JP | 2007-326704 | | 12/2007 |
| JP | 2008-210303 | | 9/2008 |
| JP | 2008-230759 | | 10/2008 |
| JP | 2008230759 | A * | 10/2008 |
| JP | 2015-180981 | | 10/2015 |
| JP | 2016-33783 | | 3/2016 |

OTHER PUBLICATIONS

International Search Report dated Dec. 20, 2016 in corresponding International Application No. PCT/JP2016/078725.
Written Opinion of the International Searching Authority dated Dec. 20, 2016 in corresponding International Application No. PCT/JP2016/078725.

* cited by examiner

PAPER SHEET FEEDING APPARATUS AND FOREIGN OBJECT DETECTION METHOD

CROSS-REFERENCE TO RELATED APPLICATION

This application is a continuation application of International Application PCT/JP2016/078725, filed on Sep. 28, 2016 and designating the U.S., the entire contents of which are incorporated herein by reference.

FIELD

The present invention relates to a paper sheet feeding apparatus and a foreign object detection method.

BACKGROUND

For example, an automated teller machine (ATM) includes a banknote handling apparatus that handles banknotes as paper sheets. The banknote handling apparatus includes a deposit and withdrawal unit for depositing and withdrawing banknotes, and the deposit and withdrawal unit is provided with a banknote feeding apparatus for feeding banknotes into the banknote handling apparatus. This type of banknote feeding apparatus includes an inserting unit in which banknotes are input, and is configured to separate and pick up, one by one, the banknotes, which are inserted in the inserting unit, and feed the banknotes into the banknote handling apparatus.

Patent Literature 1: Japanese Laid-open Patent Publication No. 2015-180981

Patent Literature 2: Japanese Laid-open Patent Publication No. 2016-33783

Meanwhile, in some cases, a plurality of banknotes that are bundled together with a bundling member, such as an elastic band, a clip, or a staple, may be inserted in the inserting unit of the banknote feeding apparatus. In this case, the banknote feeding apparatus is not able to separate, one by one, the banknotes that are bundled together with the bundling member, but feeds the banknotes that are bundled together with the bundling member, so that a conveying path may be clogged with the banknotes or the bundling member, or the banknote feeding apparatus may be damaged by the bundling member.

As a banknote feeding apparatus of a related technology, for example, a configuration for imaging the bundling member by a camera and analyzing the captured image to detect the bundling member, and a configuration for detecting a metal foreign object, such as a clip, using a magnetic sensor, have been known. However, by adding the configuration as described above to the banknote feeding apparatus, a manufacturing cost of the banknote feeding apparatus increases, which is a disadvantage.

SUMMARY

According to an aspect of the embodiments, a paper sheet feeding apparatus includes: an inserting unit in which a paper sheet is inserted; a pick-up roller for picking up the paper sheet inserted in the inserting unit; a rotating shaft for rotating the pick-up roller; a detecting member which is supported by the rotating shaft so as to be able to rotate around the rotating shaft, and which is rotated by a bundling member that bundles paper sheets together; and a first detecting unit that detects rotation of the detecting member.

The object and advantages of the invention will be realized and attained by means of the elements and combinations particularly pointed out in the claims.

It is to be understood that both the foregoing general description and the following detailed description are exemplary and explanatory and are not restrictive of the invention.

DESCRIPTION OF EMBODIMENTS

Hereinafter, embodiments of a paper sheet feeding apparatus and a foreign object detection method disclosed in the present application, will be described in detail based on the drawings. The paper sheet feeding apparatus and the foreign object detection method disclosed in the present application are not limited by the embodiments below.

Embodiments (Configuration of Banknote Handling Apparatus)

Figure 1:
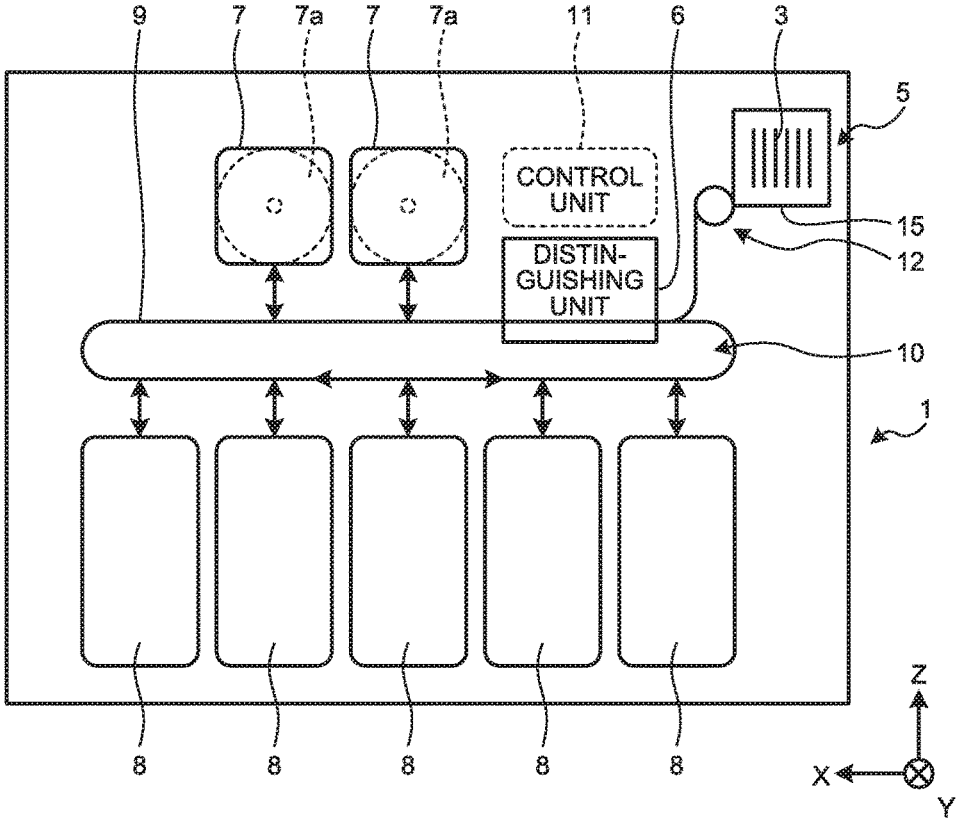
FIG. 1 is a schematic diagram illustrating a banknote handling apparatus according to an embodiment.

FIG. 1 is a schematic diagram illustrating a banknote handling apparatus according to an embodiment. As illustrated in FIG. 1, a banknote handling apparatus 1 according to the embodiment includes a deposit and withdrawal unit 5 for depositing and withdrawing banknotes 3, a distinguishing unit 6 for distinguishing the banknotes 3, a plurality of holding units 7 serving as accommodating units for temporarily accommodating the banknotes 3, and a plurality of storage units 8 for storing the banknotes 3. In addition, the banknote handling apparatus 1 includes a conveying mechanism 10, which includes a two-way direction conveying path 9 that connects the deposit and withdrawal unit 5, the distinguishing unit 6, the holding units 7, and the storage units 8 to one another and that conveys the banknotes 3 in two directions, and a control unit 11 that controls the conveying mechanism 10.

The deposit and withdrawal unit 5 in the banknote handling apparatus 1 functions both as a deposit unit and a withdrawal unit, but the deposit unit and the withdrawal unit may be provided separately. In the embodiment, the deposit unit and the withdrawal unit are collectively referred to as the deposit and withdrawal unit 5. The holding units 7 are of wind-up drum types that accommodate the banknotes 3 by winding up the banknotes 3 around wind-up drums 7*a*. The banknotes 3 are classified by denominations, and stored in the storage units 8. Meanwhile, the banknote handling apparatus 1 does not necessarily have to include the plurality of holding units 7 and the plurality of storage units 8, but it is satisfactory to include at least the single holding unit 7 and the single storage unit 8. In addition, the control unit 11 controls each of the deposit and withdrawal unit 5, the distinguishing unit 6, the holding units 7, and the storage units 8.

For the sake of simplicity of explanation, in FIG. 1 and subsequent drawings, as one example of arrangement of the banknote handling apparatus 1, a depth direction of the banknote handling apparatus 1 is referred to as an X-direction, a width direction of the banknote handling apparatus 1 (a direction perpendicular to the sheet of FIG. 1) is referred to as a Y-direction, and a height direction of the banknote handling apparatus 1 is referred to as a Z-direction. In the banknote handling apparatus 1, the X-, Y-, and Z-directions are not limited to this example.

The banknote 3 includes a banknote that is made with a resin material, such as polymer. Further, the banknote handling apparatus 1 according to the present invention will be described by using, for example, the banknote 3 as one example of a paper sheet in the embodiment; however, the paper sheet is not limited to the banknote 3. Examples of the paper sheet include a check, a cash voucher, a negotiable instrument, a voucher, and other media having monetary values, in addition to the banknote 3.

(Configuration of Banknote Feeding Apparatus)

As illustrated in FIG. 1, the deposit and withdrawal unit 5 is provided with a banknote feeding apparatus 12 for feeding the banknotes 3, which are deposited in the deposit and withdrawal unit 5, to the two-way direction conveying path 9. The banknote feeding apparatus 12 is connected to the control unit 11, and controlled by the control unit 11.

Figure 2:
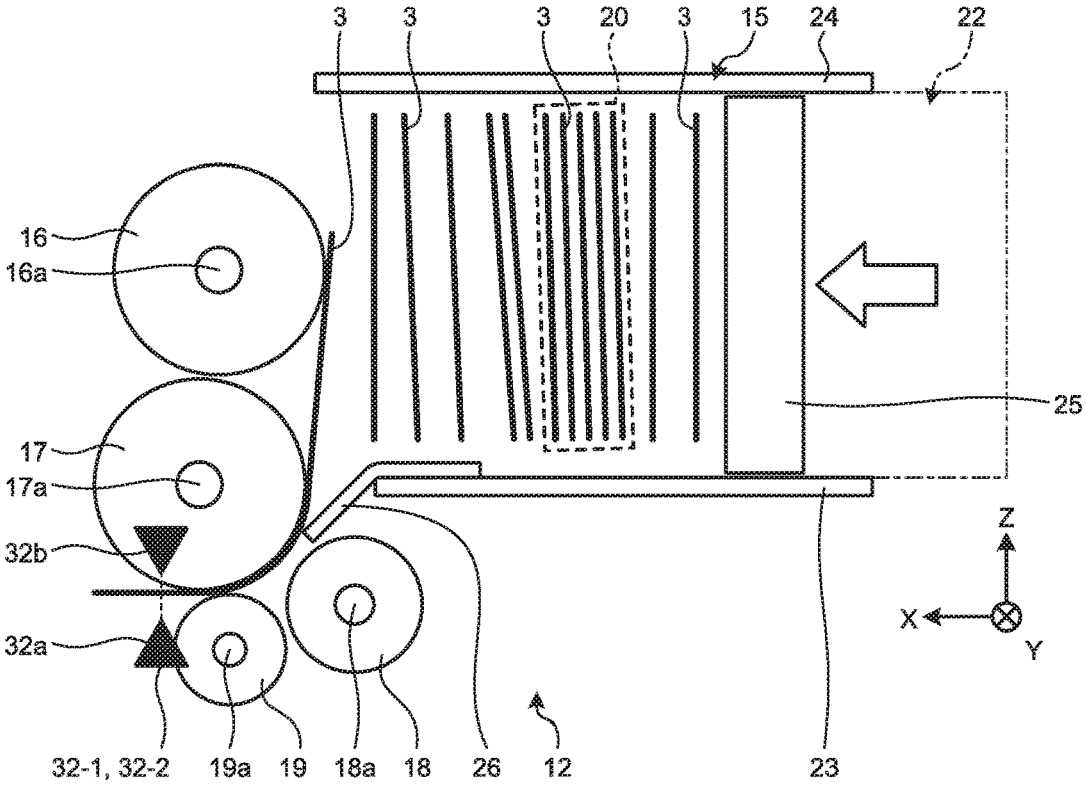
FIG. 2 is a schematic diagram illustrating a banknote feeding apparatus included in the banknote handling apparatus according to the embodiment.
Figure 3:
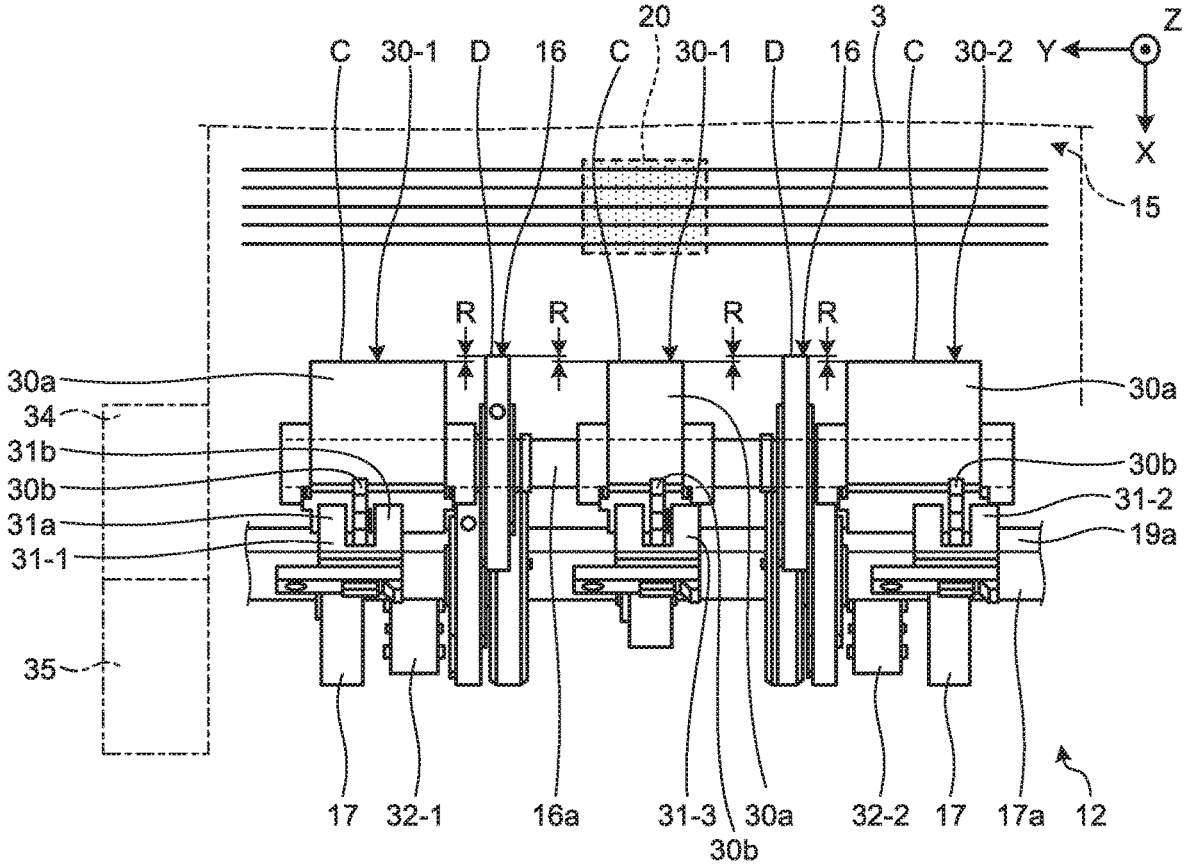
FIG. 3 is a plan view illustrating the banknote feeding apparatus according to the embodiment.
Figure 4:
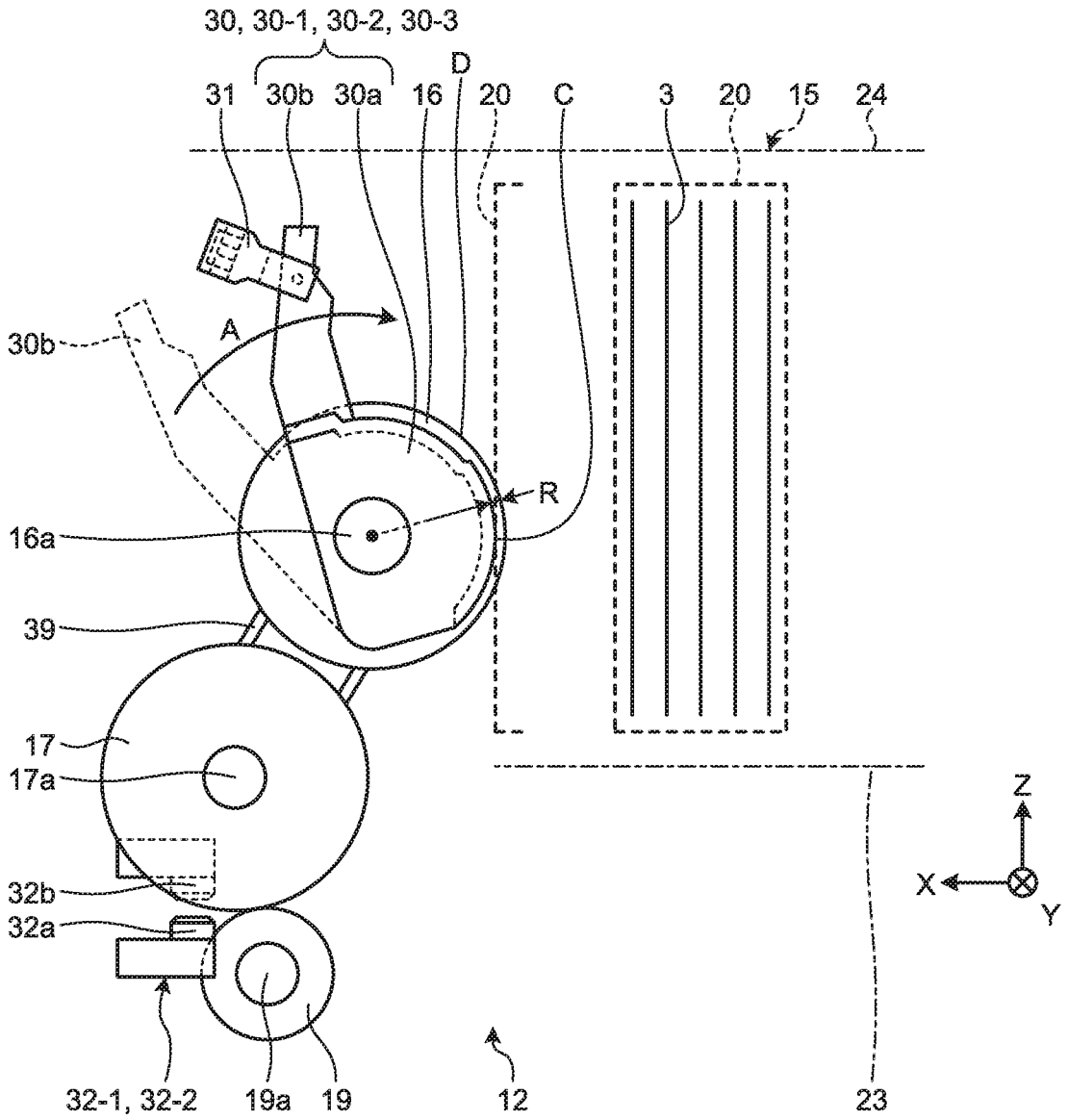
FIG. 4 is a side view illustrating the banknote feeding apparatus according to the embodiment.
Figure 5:
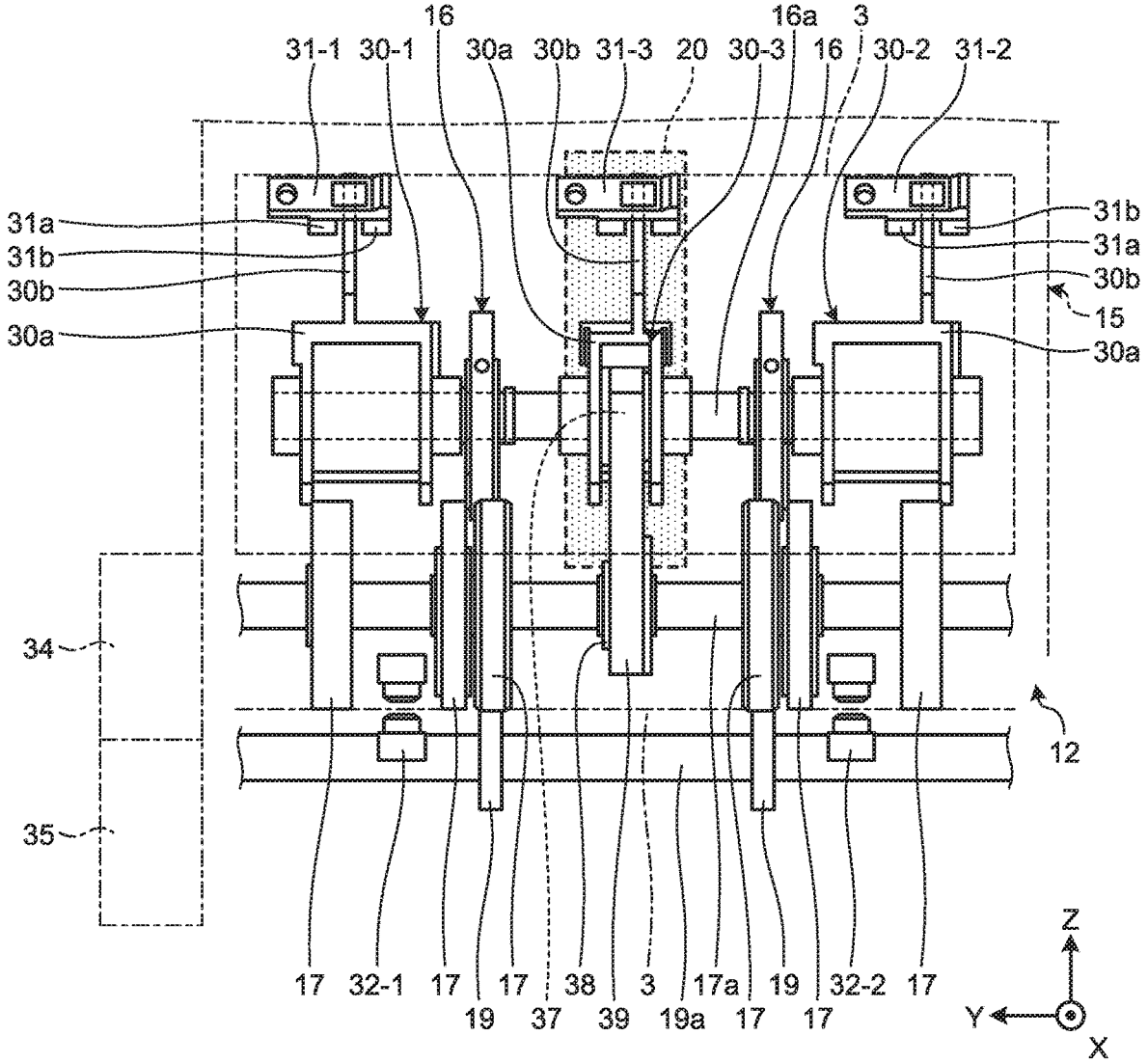
FIG. 5 is a back view of the banknote feeding apparatus according to the embodiment viewed from a side opposite to an inserting unit side.

FIG. 2 is a schematic diagram illustrating the banknote feeding apparatus 12 included in the banknote handling apparatus 1 according to the embodiment. FIG. 3 is a plan view illustrating the banknote feeding apparatus 12 according to the embodiment. FIG. 4 is a side view illustrating the banknote feeding apparatus 12 according to the embodiment. FIG. 5 is a back view of the banknote feeding apparatus 12 according to the embodiment viewed from a side opposite to the inserting unit side.

As illustrated in FIG. 2, the banknote feeding apparatus 12 according to the embodiment includes an inserting unit 15 for inserting the banknotes 3, a plurality of pick rollers 16 as pick-up rollers for picking up the banknotes 3 that are inserted in the inserting unit 15, a plurality of feed rollers 17 serving as feeding rollers, a plurality of separation rollers 18 that rotate together with the feed rollers 17 and that separate the banknotes one by one, and a plurality of conveying rollers 19 that rotate together with the feed rollers 17 and that convey the banknote 3.

In addition, as illustrated in FIG. 2, the banknote feeding apparatus 12 includes a rotating shaft 16*a* that supports the pick rollers 16, a rotating shaft 17*a* that supports the feed rollers 17, a rotating shaft 18*a* that supports the separation rollers 18, and a rotating shaft 19*a* that supports the conveying rollers 19. The plurality of pick rollers 16, feed rollers 17, separation rollers 18, and conveying rollers 19 are arranged at predetermined intervals in the axial directions of the respective rotating shafts 16*a*, 17*a*, 18*a*, and 19*a*. All of the rotating shafts 16*a*, 17*a*, 18*a*, and 19*a* are arranged parallel to one another, and supported by a frame (not illustrated). Each of the rotating shafts 16*a*, 17*a*, 18*a*, and 19*a* is driven by a driving mechanism 34 to be described later, and rotates each of the pick rollers 16, the feed rollers 17, the separation rollers 18, and the conveying rollers 19.

The banknote 3 has a rectangular shape for example, and is inserted in the inserting unit 15 while being oriented such that a long side of the banknote 3 is along the rotating shaft 16*a* of the pick rollers 16 and a short side is along a feeding direction of the pick rollers 16. In other words, the banknote 3 is inserted in the inserting unit 15 while being oriented such that a thickness direction of the banknote 3 is along the X-direction, a long-side direction of the banknote 3 is along the Y-direction, and a short-side direction of the banknote 3 is along the Z-direction. In addition, the banknotes 3 are inserted in the inserting unit 15 such that they are stacked and their orientations are aligned.

As illustrated in FIG. 2, the inserting unit 15 includes a moving mechanism 22 that moves the banknotes 3, which are inserted in the inserting unit 15 at the time of deposit, toward the pick rollers 16 side in the X-direction. The moving mechanism 22 includes a bottom plate 23, on which the banknotes 3 are placed such that the long-side direction is oriented downward, a top plate 24 that covers the inserting unit 15 in an openable and closable manner, a stage 25 that is provided so as to be able to move back and forth along the bottom plate 23, and a guide plate 26 that guides the banknotes 3, which are moved by the stage 25, to a gap between the feed rollers 17 and the separation rollers 18.

The moving mechanism 22 moves the stage 25 in the X-direction to press the banknotes 3 toward the pick rollers 16 side by a predetermined pressing force, and the banknotes are appropriately fed with use of outer peripheries of the pick rollers 16. In addition, after all of the banknotes 3, which are inserted in the inserting unit 15, are fed, the moving mechanism 22 is controlled by the control unit 11 so as to return the stage 25 to an initial position that is away from the pick rollers 16 side in the X-direction. Furthermore, the inserting unit 15 is configured to accommodate the banknotes 3, which are to be withdrawn from the storage units 8 of the banknote handling apparatus 1 at the time of withdrawal.

(Configurations of Detecting Member and First Detecting Unit)

In addition, as illustrated in FIG. 3, FIG. 4, and FIG. 5, the banknote feeding apparatus 12 includes detecting members 30 which rotate around the rotating shaft 16*a* of the pick rollers 16 by coming into contact with a bundling member 20 that bundles the banknotes 3 together, and a plurality of first detecting units 31 that detect rotation of the detecting members 30.

As illustrated in FIG. 3 and FIG. 5, the detecting members 30 include both-end detecting members 30-1 and 30-2 that are arranged on both end sides in the direction of the rotating shaft 16*a*, and a central detecting member 30-3 that is arranged on the center side in the direction of the rotating shaft 16*a*. The first detecting units 31 include first both-end detecting parts 31-1 and 31-2 that respectively detect rotation of the both-end detecting members 30-1 and 30-2, and a first central detecting part 31-3 that detects rotation of the central detecting member 30-3. Hereinafter, for the sake of simplicity of explanation, common description among the both-end detecting members 30-1 and 30-2 and the central detecting member 30-3 will be provided as description of the detecting members 30. Similarly, common description among the first both-end detecting parts 31-1 and 31-2 and the first central detecting part 31-3 will be provided as description of the first detecting units 31.

As illustrated in FIG. 3 and FIG. 5, the both-end detecting members 30-1 and 30-2 are arranged on both end sides of the rotating shaft 16*a* relative to the positions of the pick rollers 16 in the axial direction of the rotating shaft 16*a*. The central detecting member 30-3 is arranged between the two pick rollers 16 that are spaced apart from each other in the axial direction of the rotating shaft 16*a*.

The detecting members 30 (30-1, 30-2, 30-3) are formed in substantially semi-cylindrical shapes using a resin material or a metal material for example, and include rotating parts 30*a* that are supported by the rotating shaft 16*a* so as to be able to rotate around the rotating shaft 16*a* of the pick rollers 16, and light shielding units 30*b* that block detection light of the first detecting units 31 as illustrated in FIG. 3, FIG. 4, and FIG. 5.

The rotating parts 30*a* of the detecting members 30 are rotatably provided on the rotating shaft 16*a* via bearing members (not illustrated), for example. The rotating parts 30*a* may be provided with biasing members (not illustrated) such that the rotating parts are biased to take predetermined postures around the rotating shaft 16*a*, or the rotating parts 30*a* may be configured to be rotated by the bundling member 20 against biasing forces of the biasing members. The light shielding units 30*b*, which are included in the detecting members 30, are formed in plate shapes with thicknesses in the direction of the rotating shaft 16*a*, and extend from the outer peripheries of the rotating parts 30*a* in a radial direction of the rotating shaft 16*a*.

The outer peripheries of the rotating parts 30*a*, which are included in the detecting members 30, function as contact surfaces C, with which the bundling member 20 comes into contact. As illustrated in FIG. 3 and FIG. 4, the contact surfaces C are provided along outer peripheries D of the pick rollers 16 in the radial direction of the rotating shaft 16*a* (the pick rollers 16). In addition, in the radial direction of the rotating shaft 16*a*, the contact surfaces C are located closer to the center side of the rotating shaft 16*a* by a predetermined distance R relative to the outer peripheries D of the pick roller 16. In other words, the contact surfaces C of the rotating parts 30*a* have smaller diameters than the pick rollers 16 so as to provide a predetermined amount of steps from the outer peripheries D of the pick rollers 16 in the radial direction of the pick rollers 16.

The predetermined distance R described above is set to about 1 millimeter (mm) for example, and the contact surfaces C according to the present embodiment are set based on a thickness of the bundling member 20 that is adopted as a detection target (for example, a thickness of an elastic band or the like in the thickness direction of a bundle of the banknotes 3). In addition, the contact surfaces C may be subjected to a surface roughening process, such as a fine concave-convex process, in order to improve operability during contact with the bundling member 20, or may be provided with a rubber member for improving a friction coefficient.

Meanwhile, in the rotating parts 30*a* of the detecting members 30, widths of the contact surfaces C in the direction of the rotating shaft 16*a* correspond to detection ranges, in which the bundling member 20 is detectable in the long-side direction of the banknotes 3, and it is preferable to increase the widths. However, by increasing the widths of the contact surfaces C, rotational resistance of the detecting members 30 may increase; therefore, the widths are appropriately set by taking into account both the reliability of rotational operation of the detecting members 30 and sizes of the detection ranges.

As illustrated in FIG. 4, the first detecting unit 31 is arranged at a predetermined position, at which the light shielding unit 30*b* enters when the detecting member 30 rotates around the rotating shaft 16*a*, on a rotation trajectory of the light shielding unit 30*b* of the detecting member 30 that rotates around the rotating shaft 16*a*, and is connected to the control unit 11. The first detecting unit 31 is configured using, for example, an optical sensor, and includes a light-emitting unit 31*a* that emits detection light and a light-receiving unit 31*b* that receives the light emitted by the light-emitting unit 31*a* as illustrated in FIG. 3 and FIG. 5. The light-emitting unit 31*a* and the light-receiving unit 31*b* are arranged so as to face each other across a space through which the light shielding unit 30*b* of the detecting member 30 that rotates around the rotating shaft 16*a* can pass.

When the detecting member 30 rotates in an A direction illustrated in FIG. 4 and the light shielding unit 30*b* of the detecting member 30 enters a gap between the light-emitting unit 31*a* and the light-receiving unit 31*b* and blocks the detection light, the first detecting unit 31 detects rotation of the detecting member 30. As an alternative to the detection as described above, the first detecting unit 31 may detect rotation of the detecting member 30 when the light shielding unit 30*b* of the detecting member 30 comes out of the gap between the light-emitting unit 31*a* and the light-receiving unit 31*b* and an inclined state of the detection light is eliminated upon rotation of the detecting member 30. Meanwhile, the first detecting unit 31 is not limited to the optical sensor, but a mechanical sensor that detects rotation of the detecting member 30, may be used.

As the bundling member 20 that bundles the banknotes 3 together, various kinds of the bundling member 20, such as an elastic band, a rubber band, a clip, and a staple, may be adopted for example; however, as the bundling member 20 to be detected by the detecting members 30 (30-1, 30-2, 30-3), it is assumed that the bundling member 20, such as an elastic band or a rubber band, that is made with an elastic member and formed in a ring shape or a band shape, will be detected. Meanwhile, the detecting members 30 are able to detect not only the bundling member 20 such as an elastic band or a rubber band, but also the bundling member 20, such as a rubber clip or a metal clip, that has a surface subjected to a roughening process and has a higher surface friction coefficient than a metal clip or the like that has a flat and smooth surface.

Incidentally, the banknote feeding apparatus 12 according to the embodiment includes the three members such as the both-end detecting members 30-1 and 30-2 and the central detecting member 30-3 for detecting the bundling member 20 in three detection ranges in the long-side direction of the banknotes 3; however, embodiments are not limited to this configuration. The banknote feeding apparatus 12 may include only the central detecting member 30-3 or only the both-end detecting members 30-1 and 30-2. In addition, the banknote feeding apparatus 12 may include, for example, four or more detecting members 30 that are arranged at regular intervals in the direction of the rotating shaft 16*a* to improve detection accuracy of the bundling member 20.

(Configuration of Second Detecting Unit)

In addition, as illustrated in FIG. 4 and FIG. 5, the banknote feeding apparatus 12 includes a pair of second detecting units 32-1 and 32-2 for detecting inclined states of the banknotes 3 with respect to a direction, in which the banknotes 3 are fed by the pick rollers 16, and the driving mechanism 34 that drives the feed rollers 17 and the like.

The second detecting units 32-1 and 32-2 are arranged on the downstream side of the feed rollers 17 in a direction, in which the banknotes 3 are fed by the pick rollers 16. The second detecting units 32-1 and 32-2 are configured using, for example, optical sensors, and include light-emitting units 32*a* that emit detection light, and light-receiving units 32*b* that receive the detection light emitted by the light-emitting units 32*a* as illustrated in FIG. 2 and FIG. 4. The light-emitting units 32*a* and the light-receiving units 32*b* are arranged so as to face each other across spaces through which the banknotes 3, which are conveyed by the feed rollers 17 and the conveying rollers 19, can pass.

The second detecting units 32-1 and 32-2 function as position sensors that detect passing of the banknotes 3, which are conveyed by the feed rollers 17 and the conveying rollers 19, and also function as inclination sensors that detect inclined states of the banknotes 3, which are conveyed by the feed rollers 17 and the conveying rollers 19. The second detecting units 32-1 and 32-2 as a pair are arranged at a predetermined interval in the direction of the rotating shaft 17*a* of the feed rollers 17 (the direction of the rotating shaft 19*a* of the conveying rollers 19), and the predetermined interval is set based on the length of the long side of the banknotes 3 to be handled.

When the bundling member 20, such as a clip or a staple, is not detected by the first detecting units 31 (31-1, 31-2, 31-3) as described above and the banknotes 3, which are bundled together with the bundling member 20, are fed by the pick rollers 16 for example, the second detecting units 32-1 and 32-2 detect the banknotes 3 that are bundled together with the bundling member 20. For example, when the plurality of banknotes 3 are bundled together by attaching the bundling member 20 at one edges of their outer circumferences, one of the banknotes 3 may come off from the bundling member 20 and may be separated and fed as one sheet by the feed rollers 17 and the separation rollers 18. In this case, the banknote 3 is not fed straightforwardly with respect to the feeding direction due to the influence of a bundling force of the bundling member 20, but the banknote 3 is fed to the feed rollers 17 and the conveying rollers 19 while being inclined with respect to the feeding direction. Further, when the plurality of banknotes 3 bundled together with the bundling member 20, such as a clip or a staple, are fed by the feed rollers 17, the banknotes 3 are likely to be fed while being inclined with respect to the feeding direction, due to the presence of the bundling member 20 having a different friction coefficient from that of the banknotes 3, or due to the influence of deviation of the position of center of gravity of the whole banknotes, which are bundled together with the bundling member 20, toward one end side in the long-side direction.

When the banknotes 3 are fed in an inclined manner as described above, it is determined whether the banknotes are inclined on the basis of a time lag between timings at which the second detecting units 32-1 and 32-2 as a pair detect the banknotes 3. If the time lag exceeds a threshold, the control unit 11 determines that the banknotes 3 are inclined.

In this manner, the second detecting units 32-1 and 32-2 detect inclined states of the banknotes 3 when the banknotes 3, which are bundled together with the bundling member 20, are fed, and thus it is possible to detect presence or absence of the bundling member 20. The second detecting units 32-1 and 32-2 detect passing of the banknotes 3 that are bundled together with a metal clip or staple, rather than an elastic band or a rubber band, that is not detected as the bundling member 20 by the first detecting units 31.

The driving mechanism 34 is controlled by the control unit 11 as described above. As illustrated in FIG. 4 and FIG. 5, the driving mechanism 34 includes a single pulse motor (stepping motor) 35 as a driving source, and drives each of the pick rollers 16, the feed rollers 17, the separation rollers 18, and the conveying rollers 19 by using the pulse motor 35. Accordingly, the driving mechanism 34 drives each of the pick rollers 16 and the like using the single pulse motor 35, so that it is possible to promptly switch to a stop state from a forward rotation state, in which the banknotes 3 are conveyed in the feeding direction, and to a reverse rotation state from the stop state, in accordance with a control signal received from the control unit 11, and the configuration of the driving mechanism 34 is simplified.

In addition, as illustrated in FIG. 4 and FIG. 5, the driving mechanism 34 includes a pulley 37 that is provided on the rotating shaft 16*a* of the pick rollers 16, a pulley 38 that is provided on the rotating shaft 17*a* of the feed rollers 17, and a driving belt 39 that is stretched between the pulleys 37 and 38. The driving mechanism 34 causes the pick rollers 16 and the feed rollers 17 to rotate in conjunction with each other via the driving belt 39.

(Operation of Detecting Bundling Member by First Detecting Unit)

First, when the banknote 3, which is not bundled with the bundling member 20, is inserted in the inserting unit 15 in the banknote feeding apparatus 12, the banknote 3 is brought in pressure contact with the pick rollers 16 side by the stage 25 of the moving mechanism 22, so that the banknote 3 comes into contact with the outer peripheries of the pick rollers 16, and the banknote 3 is fed by the pick rollers 16. In this case, the contact surfaces C of the detecting members 30 are recessed at positions that are closer to the rotating shaft 16*a* side relative to the outer peripheries of the pick rollers 16 in the radial direction of the pick rollers 16. Therefore, the banknote 3, which is pressed by the pick rollers 16, does not come into contact with the contact surfaces C, and the detecting members 30 are not rotated by the banknote 3. Consequently, the detecting members 30 do not rotate when the banknote 3 is fed, so that the first detecting units 31 do not detect the bundling member 20.

In contrast, even when the banknotes 3, which are bundled together with the bundling member 20, such as an elastic band, are inserted in the inserting unit 15 in the banknote feeding apparatus 12, the banknotes 3 are brought in pressure contact with the pick rollers 16 side by the stage 25 of the moving mechanism 22. In this case, the banknotes 3 come into contact with the outer peripheries of the pick rollers 16, and the bundling member 20 protruding in the thickness direction (X-direction) of the banknotes 3, which are bundled together with the bundling member 20, comes into contact with the contact surfaces C of the detecting members 30 as illustrated in FIG. 4. As the banknotes 3, which are bundled together with the bundling member 20, are fed by the pick rollers 16, the bundling member 20 moves together with the banknotes 3. At this time, the bundling member 20 moves together with the banknotes 3, so that the detecting members 30 are rotated in the A direction around the rotating shaft 16*a* due to a frictional force of the bundling member 20, which is pressed by the contact surfaces C. With the rotation of the detecting members 30, the light shielding units 30*b* block the detection light of the first detecting units 31, so that the first detecting units 31 detect the rotation of the detecting members 30.

In general, the bundling member 20, such as an elastic band, for bundling the plurality of banknotes 3 together, is usually attached in the center in the long-side direction of the banknotes 3, and therefore, the bundling member 20, such as an elastic band, is mostly detected by the central detecting member 30-3. Further, even when the bundling member 20 is attached to one end side in the long-side direction of the banknotes 3, the bundling member 20, such as an elastic band, is detected by either one of the both-end detecting members 30-1 and 30-2.

(Control Operation of Driving Mechanism Based on Detection Result of First Detecting Unit)

Figure 6:
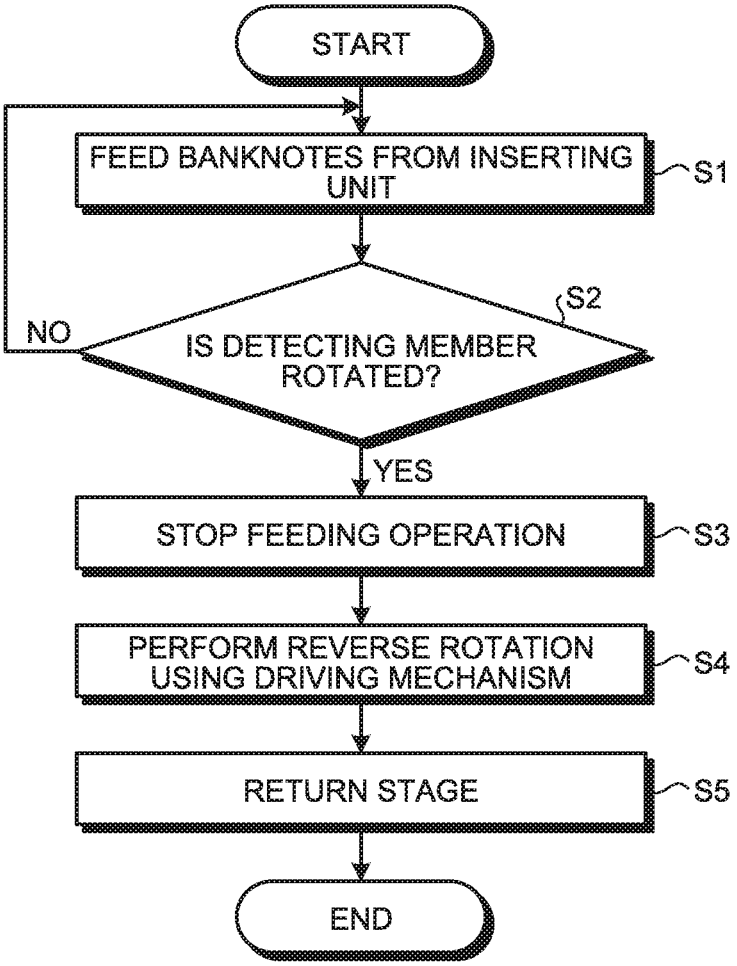
FIG. 6 is a flowchart for explaining control operation of a driving mechanism in a case where a first detecting unit detects a bundling member in the banknote feeding apparatus according to the embodiment.

FIG. 6 is a flowchart for explaining control operation of the driving mechanism 34 in a case where the first detecting units 31 detect the bundling member 20. As described above, in the banknote feeding apparatus 12, as illustrated in FIG. 6, the banknotes 3, which are inserted in the inserting unit 15, are fed by the pick rollers 16 (Step S1), and the control unit 11 determines presence or absence of rotation of the detecting members 30 based on a detection result of the first detecting units 31 (Step S2). If the rotation of the detecting members 30 is not detected (NO at Step S2), the control unit 11 continues operation of feeding the banknotes 3 using the pick rollers 16.

In contrast, if the first detecting units 31 detect rotation of the detecting members 30 (YES at Step S2), the control unit 11 stops the operation of feeding the banknotes 3 performed by the driving mechanism 34 (Step S3), and causes the driving mechanism 34 to reversely rotate the pick rollers 16 (Step S4). Finally, the moving mechanism 22 is caused to return the stage 25 to the initial position such that the banknotes 3, which are bundled together with the bundling member 20, are moved in a direction away from the pick rollers 16 (Step S5), and the banknotes 3, which are bundled together with the bundling member 20, are returned to a user. Meanwhile, at this time, the control unit 11 may give a notice to request the user to detach the bundling member 20 using a display unit or a warning light (not illustrated).

(Operation of Detecting Bundling Member by Second Detecting Unit)

In the banknote feeding apparatus 12, in some cases, the bundling member 20, such as a clip or a staple, that bundles the banknotes 3 together, is not detected by the first detecting units 31, but the banknotes 3, which are bundled together with the bundling member 20, are fed by the pick rollers 16, and conveyed by the feed rollers 17 and the conveying rollers 19. In this case, the banknotes 3, which are bundled together with a clip, a staple, or the like, are likely to be inclined with respect to the feeding direction as described above; therefore, the second detecting units 32-1 and 32-2 as a pair detect presence or absence of inclined states of the banknotes 3, and the control unit 11 determines presence or absence of the bundling member 20. In other words, when the control unit 11 determines that the banknotes 3 are inclined based on a detection result of the second detecting units 32-1 and 32-2, the control unit 11 determines that the bundling member 20 is present. In addition, when the control unit 11 does not determine that the banknotes 3 are inclined based on a detection result of the second detecting units 32-1 and 32-2, the control unit 11 determines that the bundling member 20 is absent.

(Control Operation Performed by Driving Mechanism Based on Detection Result of Second Detecting Unit)

Figure 7:
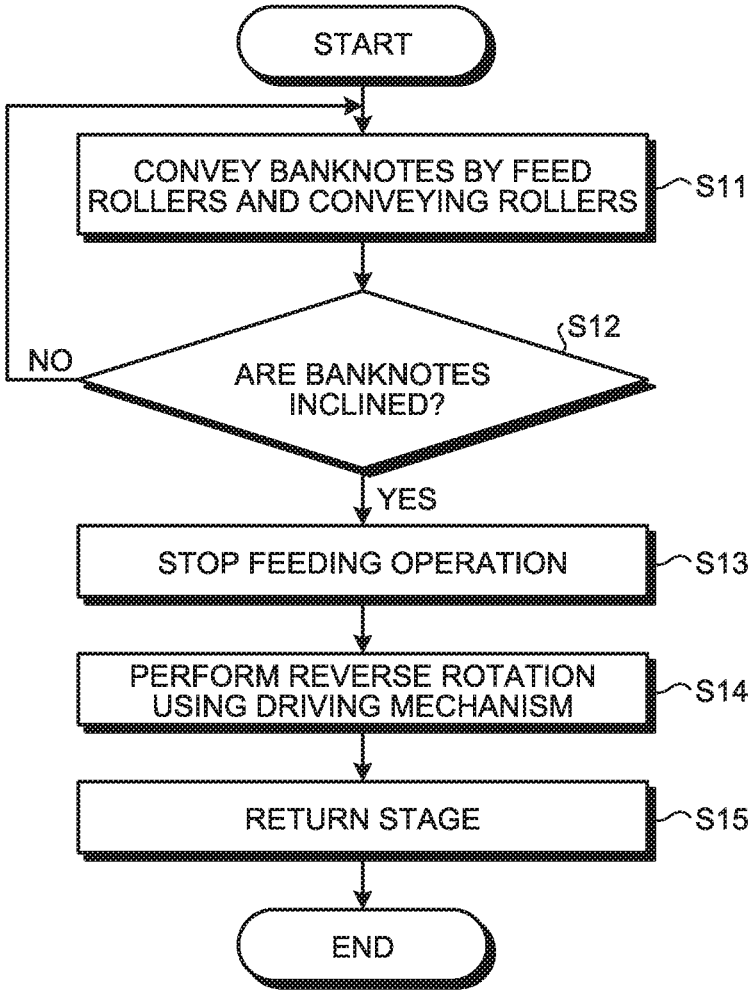
FIG. 7 is a flowchart for explaining control operation of the driving mechanism in a case where a second detecting unit detects inclined states of banknotes in the banknote feeding apparatus according to the embodiment.

FIG. 7 is a flowchart for explaining control operation performed by the driving mechanism 34 in a case where the second detecting units 32-1 and 32-2 detect inclined states of the banknotes 3 in the banknote feeding apparatus 12 according to the embodiment. As described above, in the banknote feeding apparatus 12, as illustrated in FIG. 7, the banknotes 3, which are fed from the pick rollers 16 side, are conveyed by the feed rollers 17 and the conveying rollers 19 (Step S11), and the control unit 11 determines presence or absence of inclined states of the banknotes 3 based on a detection result of the second detecting units 32-1 and 32-2 (Step S12). If the control unit 11 does not determine that the banknotes 3 are inclined (NO at Step S12), the control unit 11 continues operation of feeding the banknotes 3 using the feed rollers 17 and the conveying rollers 19.

In contrast, if the control unit 11 determines that the banknotes 3 are inclined based on a detection result of the second detecting units 32-1 and 32-2 (YES at Step S12), the control unit 11 causes the driving mechanism 34 to stop the operation of feeding the banknotes 3 (Step S13), and causes the driving mechanism 34 to reversely rotate the feed rollers 17, the conveying rollers 19, the separation rollers 18, and the pick rollers 16 (Step S14). Accordingly, the banknotes 3 and the bundling member 20 are returned to the inserting unit 15 side. Finally, the moving mechanism 22 is caused to return the stage 25 to the initial position such that the banknotes 3, which are bundled together with the bundling member 20, are moved in a direction away from the pick rollers 16 (Step S15), and the banknotes 3, which are bundled together with the bundling member 20, are returned to a user. At this time, the control unit 11 may give a notice to request the user to detach the bundling member 20 using a display unit or a warning light, similarly to the above.

(Foreign Object Detection Method)

A foreign object detection method according to the embodiment, which is for detecting the bundling member 20 using the banknote feeding apparatus 12 configured as described above, will be described. The foreign object detection method according to the embodiment includes picking up, by the pick rollers 16, the banknotes 3 that are inserted in the inserting unit 15, from the inserting unit, and detecting, by the first detecting units 31, that the detecting members 30, which are supported so as to be able to rotate around the rotating shaft **16*a* of the pick rollers 16, is rotated by the bundling member 20 that bundles the banknotes 3** together.

As described above, the banknote feeding apparatus 12 according to the embodiment includes the detecting member 30 that is supported by the rotating shaft **16*a* so as to be able to rotate around the rotating shaft 16*a*, which is for rotating the pick roller 16, and that is rotated around the rotating shaft 16*a* by the bundling member 20, and the first detecting unit 31 that detects rotation of the detecting member 30. With this configuration, the banknote feeding apparatus 12 is able to detect the bundling member 20, such as an elastic band and a rubber band, which bundles the banknotes 3 together. Therefore, according to the banknote feeding apparatus 12, it is possible to avoid an increase in a manufacturing cost of the banknote feeding apparatus 12 due to addition of a configuration for metal detection using a magnetic sensor or a configuration for image analysis of the building member 20 using a camera, and thus it is possible to realize a configuration for detecting the bundling member 20** at a relatively low cost.

Furthermore, the detecting member 30 of the banknote feeding apparatus 12 according to the embodiment has the contact surface C, which is provided along the outer periphery D of the pick roller 16 in the radial direction of the rotating shaft **16*a* of the pick roller 16 and which comes into contact with the bundling member 20, and the contact surface C is located closer to the rotating shaft 16*a* side by the predetermined distance R relative to the outer periphery D of the pick roller 16. With this configuration, it is possible to appropriately detect the bundling member 20 without causing the detecting member 30 to be rotated by the banknotes 3 that are not bundled together with the bundling member 20. Therefore, it is possible to improve the reliability of operation of the detecting member 30 and the detection accuracy of the bundling member 20**.

Moreover, the detecting member 30 of the banknote feeding apparatus 12 according to the embodiment, is arranged so as to face a center of a certain side of the banknotes 3 that are fed from the inserting unit 15, where the certain side extends along the rotating shaft 16*a*. With this configuration, the detecting member 30 is able to appropriately detect the bundling member 20 that is attached at the center of the long side of the banknotes 3, for example. In general, the bundling member 20, such as an elastic band, is mostly attached at the center of the long side of the banknotes 3, and thus it is possible to improve the reliability of operation of detecting the bundling member 20 in this state.

Furthermore, the detecting member 30 of the banknote feeding apparatus 12 according to the embodiment, is arranged so as to face each of two end sides of a certain side of the banknotes 3 that are fed from the inserting unit 15, where the certain side extends along the rotating shaft 16*a*. With this configuration, the detecting member 30 is able to appropriately detect the bundling member 20 that is attached at one of the two end sides of the long side of the banknotes 3, for example. Therefore, it is possible to improve the detection accuracy of the bundling member 20, such as a clip, that is attached at one end side of the long side of the banknote 3, for example.

Moreover, the banknote feeding apparatus 12 according to the embodiment includes a second detecting unit 32 that is arranged on the downstream side of the feed roller 17 in the direction, in which the banknotes 3 are fed, and that detects inclined states of the banknotes 3 with respect to the feeding direction. With this configuration, it is possible to detect presence or absence of the bundling member 20 based on the inclined states of the banknotes 3 that are bundled together with the bundling member 20, such as a clip or a staple, which is not detected by the first detecting unit 31. Therefore, it is possible to further improve the detection accuracy of the bundling member 20.

Furthermore, the control unit 11 of the banknote feeding apparatus 12 according to the embodiment causes the feed roller 17 to reversely rotate when the second detecting unit 32 detects inclined states of the banknotes 3. With this configuration, it is possible to return the banknotes 3, which are bundled together with the bundling member 20, to the inserting unit 15 side.

Moreover, the driving mechanism 34 of the banknote feeding apparatus 12 according to the embodiment drives the pick rollers 16, the feed rollers 17, and the separation rollers 18 using the single pulse motor 35. In this manner, by driving the pick rollers 16, the feed rollers 17, and the separation rollers 18 using the single pulse motor 35, it is possible to simplify the driving mechanism 34, promptly cause reverse rotation to occur by the pulse motor 35, and switch to operation of returning the banknotes 3, which are bundled together with the bundling member 20, to a user.

Furthermore, the control unit 11 of the banknote feeding apparatus 12 according to the embodiment causes the moving mechanism 22 to move the banknote 3 in a direction away from the pick rollers 16 after the second detecting unit 32 detects inclined states of the banknotes 3. Therefore, it is possible to return the banknotes 3 to the user using the moving mechanism 22.

According to an embodiment of the paper sheet feeding apparatus disclosed in the present application, it is possible to realize a configuration for detecting a bundling member that bundles paper sheets together, at a relatively low cost.

All examples and conditional language provided herein are intended for the pedagogical purposes of aiding the reader in understanding the invention and the concepts contributed by the inventor to further the art, and are not to be construed as limitations to such specifically recited examples and conditions, nor does the organization of such examples in the specification relate to a showing of the superiority and inferiority of the invention. Although one or more embodiments of the present invention have been described in detail, it should be understood that the various changes, substitutions, and alterations could be made hereto without departing from the spirit and scope of the invention.

What is claimed is:

1. A paper sheet feeding apparatus comprising:

an inserting unit in which a paper sheet is inserted;

a pick-up roller for picking up the paper sheet inserted in the inserting unit;

a rotating shaft for rotating the pick-up roller;

a detecting member which is supported by the rotating shaft so as to be able to rotate around the rotating shaft, and which is rotated by a bundling member that bundles paper sheets together; and a first detecting unit that detects rotation of the detecting member, wherein the detecting member has a contact surface, which is provided along an outer periphery of the pick-up roller in a radial direction of the rotating shaft and which comes into contact with the bundling member that comes, and the contact surface is located closer to the rotating shaft side by a predetermined distance relative to the outer periphery of the pick-up roller.

2. The paper sheet feeding apparatus according to claim 1, wherein the detecting member is arranged so as to face a center of a certain side of a paper sheet that is fed from the inserting unit, the certain side extending along the rotating shaft.

3. The paper sheet feeding apparatus according to claim 1, wherein the detecting member is arranged so as to face each of two end sides of a certain side of a paper sheet that is fed from the inserting unit, the certain side extending along the rotating shaft.

4. The paper sheet feeding apparatus according to claim 1, further comprising:

a feeding roller that feeds a paper sheet, which has been picked up from the inserting unit by the pick-up roller;

a separation roller that rotates together with the feeding roller and that separates paper sheets one by one; and a second detecting unit that is arranged on a downstream side of the feeding roller in a paper sheet feeding direction and that detects an inclined state of the paper sheet with respect to the feeding direction.

5. The paper sheet feeding apparatus according to claim 4, further comprising:

a driving mechanism that drives the feeding roller; and a controller that is configured to control the driving mechanism, wherein the controller causes the feeding roller to reversely rotate when the second detecting unit detects an inclined state of a paper sheet.

6. The paper sheet feeding apparatus according to claim 5, wherein the driving mechanism includes a single pulse motor, and drives the pick-up roller, the feeding roller, and the separation roller using the pulse motor.

7. The paper sheet feeding apparatus according to claim 5, wherein the inserting unit includes a moving mechanism that moves a paper sheet toward the pick-up roller side, and the controller causes the moving mechanism to move a paper sheet in a direction away from the pick-up roller, after the second detecting unit detects an inclined state of a paper sheet.

8. A foreign object detection method comprising:

picking up, by a pick-up roller, a paper sheet inserted in an inserting unit, from the inserting unit; and detecting, by a detecting unit, that a detecting member is rotated by a bundling member which bundles paper sheets together, the detecting member being supported so as to be able to rotate around a rotating shaft of the pick-up roller wherein the method uses the detecting member having a contact surface, the contact surface being provided along an outer periphery of the pick-up roller in a radial direction of the rotating shaft, configured to come into contact with the bundling member, and located closer to the rotating shaft side by a predetermined distance relative to the outer periphery of the pick-up roller.

9. A paper sheet feeding apparatus comprising:

an inserting unit in which a paper sheet is inserted;

a pick-up roller for picking up the paper sheet inserted in the inserting unit;

a rotating shaft for rotating the pick-up roller;

a first detecting member which is arranged at one end side of a certain side of the paper sheet fed from the inserting unit, where the certain side extends along the rotating shaft, which is supported by the rotating shaft so as to be able to rotate around the rotating shaft, and which is rotated by a bundling member that bundles paper sheets together;

a second detecting member which is arranged at the other end side of a certain side of the paper sheet fed from the inserting unit, where the certain side extends along the rotating shaft, which is supported by the rotating shaft so as to be able to rotate around the rotating shaft, and which is rotated by a bundling member that bundles paper sheets together;

a one-side detecting unit that is arranged on one side in a direction of the rotating shaft, and detects rotation of the first detecting member; and an another-side detecting unit that is arranged on the other side in the direction of the rotating shaft, and detects rotation of the second detecting member.

* * * * *